US009080497B2

(12) United States Patent
Yamashiro et al.

(10) Patent No.: US 9,080,497 B2
(45) Date of Patent: Jul. 14, 2015

(54) WATER-COOLED ENGINE

(71) Applicant: HONDA MOTOR CO., LTD., Tokyo (JP)

(72) Inventors: Hayato Yamashiro, Wako (JP); Masazumi Naito, Wako (JP); Hidetoshi Wakasa, Wako (JP); Takuya Miyamura, Wako (JP); Hiroyuki Sugiura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 54 days.

(21) Appl. No.: 13/950,375

(22) Filed: Jul. 25, 2013

(65) Prior Publication Data

US 2014/0026832 A1 Jan. 30, 2014

(30) Foreign Application Priority Data

Jul. 27, 2012 (JP) ..... 2012-167427

(51) Int. Cl.
*F01P 3/02* (2006.01)
*F01P 11/04* (2006.01)

(52) U.S. Cl.
CPC . *F01P 3/02* (2013.01); *F01P 11/04* (2013.01); *F01P 2003/027* (2013.01); *F01P 2050/16* (2013.01); *F01P 2060/04* (2013.01)

(58) Field of Classification Search
CPC .. F02M 25/0732; F02M 25/0738; F01P 3/02; F01P 2003/027; F01P 2003/028; F01P 11/04; F01P 2050/16; F01P 2060/04; F01P 7/165
USPC ..... 123/41.02, 41.08, 41.44, 568.12
See application file for complete search history.

(56) References Cited

U.S. PATENT DOCUMENTS 7,299,771 B2 * 11/2007 Wei et al. ..... 123/41.08
2010/0186684 A1 * 7/2010 Utsuno ..... 123/41.1

FOREIGN PATENT DOCUMENTS

JP 2005-009350 A 1/2005

* cited by examiner

*Primary Examiner* — Lindsay Low
*Assistant Examiner* — Kevin Lathers
(74) *Attorney, Agent, or Firm* — Squire Patton Boggs (US) LLP

(57) ABSTRACT

A water-cooled engine includes first connection paths continuous with a cylinder-head-side water jacket and a second connection path continuous with a cylinder-body-side water jacket. The paths are disposed in a sidewall of a cylinder body. A thermostat valve is attached to the sidewall. An oil cooler having a cooling water lead-in pipe and a cooling water lead-out pipe is attached to one sidewall of an engine main body to face the same direction as that of the thermostat valve. The cooling water lead-in pipe and the cooling water lead-out pipe are connected to the thermostat valve.

18 Claims, 7 Drawing Sheets

WATER-COOLED ENGINE

BACKGROUND

1. Field

Embodiments of the present invention relate to a water-jacket and water pump configuration in a water-cooled engine.

2. Description of the Related Art

A water-cooled engine is known from Japanese Patent Laid-Open No. 2005-009350 (Patent Document 1). Specifically, a water-cooling oil cooler is disposed on the front surface of the lower part of the engine main body mounted in a two-wheeled motor vehicle. A lead-in water path of the oil cooler is connected to an inlet conduit of a water pump disposed on the right sidewall of a cylinder body.

However, if the lead-in water path of the water-cooling oil cooler is connected to the inlet conduit of the water pump as disclosed in the above-mentioned Patent Document 1, a problem that the length of the pipework from the lead-in water path to the inlet conduit is long occurs depending on the arrangement positions of the water pump and the oil cooler to the engine main body.

SUMMARY

The present invention is made in view of such circumstance and an object thereof is to provide a water-cooled engine that is so configured that the length of the pipework connected to a water-cooling oil cooler can be set short.

To achieve the above-described object, embodiments of the present invention provide a water-cooled engine in which a cylinder-body-side water jacket is formed in a cylinder body that is coupled to a crankcase rotatably supporting a crankshaft and has a cylinder bore. A cylinder-head-side water jacket is formed in a cylinder head coupled to the cylinder body. A water pump capable of making forced circulation of cooling water between the cylinder-body-side and cylinder-head-side water jackets and a radiator is disposed on an engine main body. The cylinder-body-side and cylinder-head-side water jackets are so formed that the cooling water is allowed to flow in the water jackets independently of each other. A first connection path, continuous with the cylinder-head-side water jacket connected to one of an inlet port and a discharge port of the water pump and a second connection path continuous with the cylinder-body-side water jacket connected to the other of the inlet port and the discharge port, are made in a sidewall of the cylinder body facing one side. A thermostat valve that makes switching between a state in which the first and second connection paths directly communicate with each other and a state in which the first and second connection paths are connected to each other via the radiator is attached to the sidewall of the cylinder body. A water-cooling oil cooler having a cooling water lead-in pipe for taking in the cooling water and a cooling water lead-out pipe for leading out the cooling water is so attached to one sidewall of the engine main body as to face the same direction as the direction of the thermostat valve. The cooling water lead-in pipe is so connected to the thermostat valve as to always communicate with the water jacket connected to the discharge port of the water pump, of the cylinder-body-side and cylinder-head-side water jackets, and the cooling water lead-out pipe is so connected to the thermostat valve as to always communicate with the water jacket connected to the inlet port of the water pump, of the cylinder-body-side and cylinder-head-side water jackets.

In another embodiment, a valve housing of the thermostat valve has an upstream chamber always communicating with the water jacket connected to the discharge port of the water pump, of the cylinder-body-side and cylinder-head-side water jackets, and a downstream chamber always communicating with the water jacket connected to the inlet port of the water pump, of the cylinder-body-side and cylinder-head-side water jackets, and is attached to the sidewall of the cylinder body. The cooling water lead-in pipe is connected via a first external conduit to an upstream connection pipe provided for the valve housing continuously with the upstream chamber, and the cooling water lead-out pipe is connected via a second external conduit to a downstream connection pipe provided for the valve housing continuously with the downstream chamber.

In another embodiment, the sidewall of the cylinder body is a front wall facing a front side in a state in which the engine main body is mounted on a vehicle. An attachment base for attaching the valve housing is formed on an outer surface of the front wall and the oil cooler is attached to a front wall of the crankcase below the thermostat valve.

In another embodiment, the radiator is disposed in front of the engine main body and the water pump is disposed more rearward than the cylinder body. A first connection port that is connected to one of the inlet port and the discharge port of the water pump and is continuous with the cylinder-head-side water jacket is provided in a rear wall of the cylinder head, and a second connection port that is connected to the other of the inlet port and the discharge port and is continuous with the cylinder-body-side water jacket is provided in a rear wall of the cylinder body.

In another embodiment, the thermostat valve is attached to the cylinder body with the actuation axis line of the thermostat valve set parallel to the axis line of the crankshaft, and the upstream connection pipe and the downstream connection pipe are so provided under the valve housing as to be arranged along the actuation axis line.

In another embodiment, the upstream connection pipe and the downstream connection pipe are so formed as to extend along a cylinder axis line.

In another embodiment, the thermostat valve and the oil cooler are so disposed as to partially overlap with each other when viewed from direction along the cylinder axis line.

In another embodiment, the plural cylinder bores arranged along the axis line of the crankshaft are formed in the cylinder body. A pair of lubricant return paths to return a lubricant from the cylinder head to the side of the crankcase via the cylinder body are formed in the front wall of the cylinder body with an interval along the arrangement direction of the cylinder bores. The thermostat valve and the oil cooler are disposed between the pair of lubricant return paths.

In yet another embodiment, the first connection path that is continuous with the cylinder-head-side water jacket and has a flattened cross-sectional shape that is long in direction along the axis line of the crankshaft is made in the front wall of the cylinder body in such a manner that a partition wall exists between the first connection path and the cylinder-body-side water jacket and the first connection path is disposed between the pair of lubricant return paths.

According to one embodiment of the present invention, the thermostat valve that makes switching between the state in which the first connection path continuous with the cylinder-head-side water jacket and the second connection path continuous with the cylinder-body-side water jacket directly communicate with each other and the state in which the first and second connection paths are connected to each other via the radiator is attached to the sidewall of the cylinder body.

Furthermore, the water-cooling oil cooler is attached to the sidewall of the engine main body while facing the same direction as that of the thermostat valve. Moreover, the cooling water lead-in pipe of the oil cooler is so connected to the thermostat valve as to lead to the water jacket connected to the discharge port of the water pump, of the cylinder-body-side and cylinder-head-side water jackets, and the cooling water lead-out pipe of the oil cooler is so connected to the thermostat valve as to lead to the water jacket connected to the inlet port of the water pump, of the cylinder-body-side and cylinder-head-side water jackets. Due to this structure, the length of the pipework connected to the oil cooler can be set short.

According to another embodiment of the present invention, the valve housing of the thermostat valve is attached to the wall of the cylinder body. The cooling water lead-in pipe is connected via the first external conduit to the upstream connection pipe that is so provided for the valve housing as to communicate with the upstream chamber leading to the water jacket connected to the discharge port of the water pump, of the cylinder-body-side and cylinder-head-side water jackets. Furthermore, the cooling water lead-out pipe is connected via the second external conduit to the downstream connection pipe that is so provided for the valve housing as to communicate with the downstream chamber leading to the water jacket connected to the inlet port of the water pump, of the cylinder-body-side and cylinder-head-side water jackets. Thus, the following advantages are achieved compared with a structure in which the cooling water lead-in pipe and the cooling water lead-out pipe of the oil cooler are connected to a branch joint provided in the middle of the external pipework coupling the oil cooler to the radiator. Specifically, the first and second external conduits can be set short. Not only that but the branch joint in the middle of the pipework can be eliminated to simplify the pipework connection structure and the seal part can be reduced with ensuring of the arrangement flexibility of the cooling water lead-in pipe and the cooling water lead-out pipe.

According to another embodiment of the present invention, the thermostat valve is directly attached to the front wall of the cylinder body in the state in which the engine main body is mounted on the vehicle and the oil cooler is attached to the front wall of the crankcase. This can eliminate external pipework between the thermostat valve and the cylinder body and shorten the distance between the thermostat valve and the oil cooler to further shorten the first and second external conduits.

According to other embodiments of the present invention, the radiator is disposed in front of the engine main body and the water pump is disposed more rearward than the cylinder body. Furthermore, exchange of the cooling water between the cylinder-body-side water jacket and the cylinder-head-side water jacket and the water pump is carried out on the rear side of the engine main body. This can shorten the circulation route of the cooling water.

According to other embodiments of the present invention, the actuation axis line of the thermostat valve is parallel to the axis line of the crankshaft, and the upstream connection pipe and the downstream connection pipe are so provided under the valve housing of the thermostat valve as to be arranged along the actuation axis line of the thermostat valve. Thus, the directions of the external conduits between the thermostat valve and the oil cooler disposed below the thermostat valve can be aligned to shorten these external conduits.

According to other embodiments, the upstream connection pipe and the downstream connection pipe extend along the cylinder axis line. Therefore, the external conduits between the thermostat valve and the oil cooler can be disposed close to the front wall of the engine main body naturally. This can suppress size increase of the engine including these external conduits.

According to other embodiments, the thermostat valve and the oil cooler partially overlap with each other when viewed from the direction along the cylinder axis line. This can further shorten the distance between the thermostat valve and the oil cooler.

According to other embodiments, in the front wall of the engine main body configured as a multi-cylinder in-line engine, the pair of lubricant return paths to return the lubricant from the cylinder head to the side of the crankcase via the cylinder body are formed with an interval along the arrangement direction of the cylinder bores. Furthermore, the thermostat valve and the oil cooler are disposed between both the lubricant return paths. Thus, the thermostat valve and the oil cooler are effectively disposed in the space between both the lubricant return paths. This can suppress size increase of the engine and shorten the distance between the thermostat valve and the oil cooler.

According to other embodiment of the present invention, the first connection path continuous with the cylinder-head-side water jacket is so formed as to have a flattened cross-sectional shape that is long in the direction along the axis line of the crankshaft. Furthermore, the first connection path is made in the front wall of the cylinder body between the pair of lubricant return paths in such a manner that the partition wall exists between the first connection path and the cylinder-body-side water jacket. Therefore, the first connection path can be so disposed that interference with the lubricant return paths is avoided and frontward bulging of the front wall of the cylinder body is suppressed to avoid size increase of the engine main body.

DETAILED DESCRIPTION

Embodiments of the present invention will be described below with reference to accompanying FIGS. 1 to 7. In the following description, the upper, lower, left, and right directions are described as directions from the viewpoint of the rider who rides on the two-wheeled motor vehicle.

Figure 1:
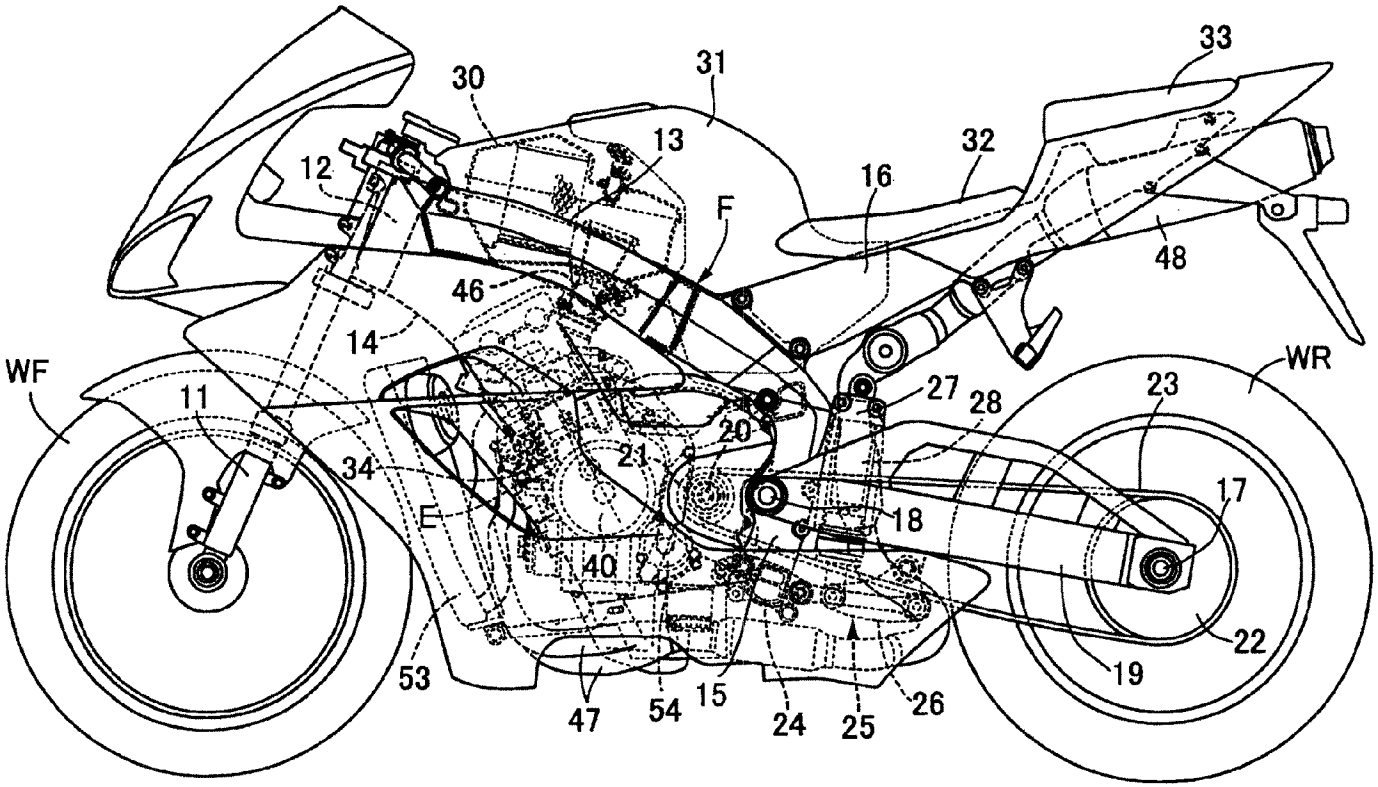
FIG. 1 is a left side view of a two-wheeled motor vehicle.

Referring first to FIG. 1, a vehicle body frame F of the two-wheeled motor vehicle as a vehicle can include a head pipe 12 that steerably supports a front fork 11 rotatably supporting a front wheel WF. A pair of left and right main frames 13 extend from this head pipe 12 rearward and downward. A pair of left and right engine hangers 14 are provided continuously with the front parts of the head pipe 12 and both main frames 13 and extend rearward and downward under the main frames 13. A pair of left and right pivot frames 15 are provided continuously with the rear end parts of the main frames 13 and extend downward. A pair of left and right seat rails 16 extend rearward and upward and are coupled to the rear parts of both main frames 13.

An engine main body 34 of a water-cooled engine E that is a four-cylinder engine is so mounted on the vehicle body frame F as to be located under the main frames 13. An axle 17 of a rear wheel WR driven to rotate by power output from this engine E is rotatably supported by the rear end part of a swing arm 19, and the front end part of this swing arm 19 is vertically swingably supported by the pivot frames 15 with the intermediary of a pivot shaft 18. A gear transmission (not shown) is included in the engine main body 34 and an endless chain 23 is wound around a drive sprocket 21 fixed to an output shaft 20 of the gear transmission and a driven sprocket 22 fixed to the axle 17.

A link mechanism 25 is provided between a cross pipe 24 coupling the lower parts of the pivot frames 15 to each other and the swing arm 19. A rear cushion unit 28 is provided between a link member 26 serving as part of the link mechanism 25 and a bracket 27 provided at the front part of the swing arm 19.

An air cleaner 30 is so disposed above the engine main body 34 as to be located behind the head pipe in the vehicle body frame F, and a fuel tank 31 covering the rear part and upper part of this air cleaner 30 is mounted on both main frames 13 in the vehicle body frame F. Behind the fuel tank 31, a main seat 32 for riding of the rider thereon is supported on the seat rails 16. A pillion seat 33 for riding of a fellow passenger thereon is supported by the seat rails 16 at a position separate from the main seat 32 rearward.

Figure 2:
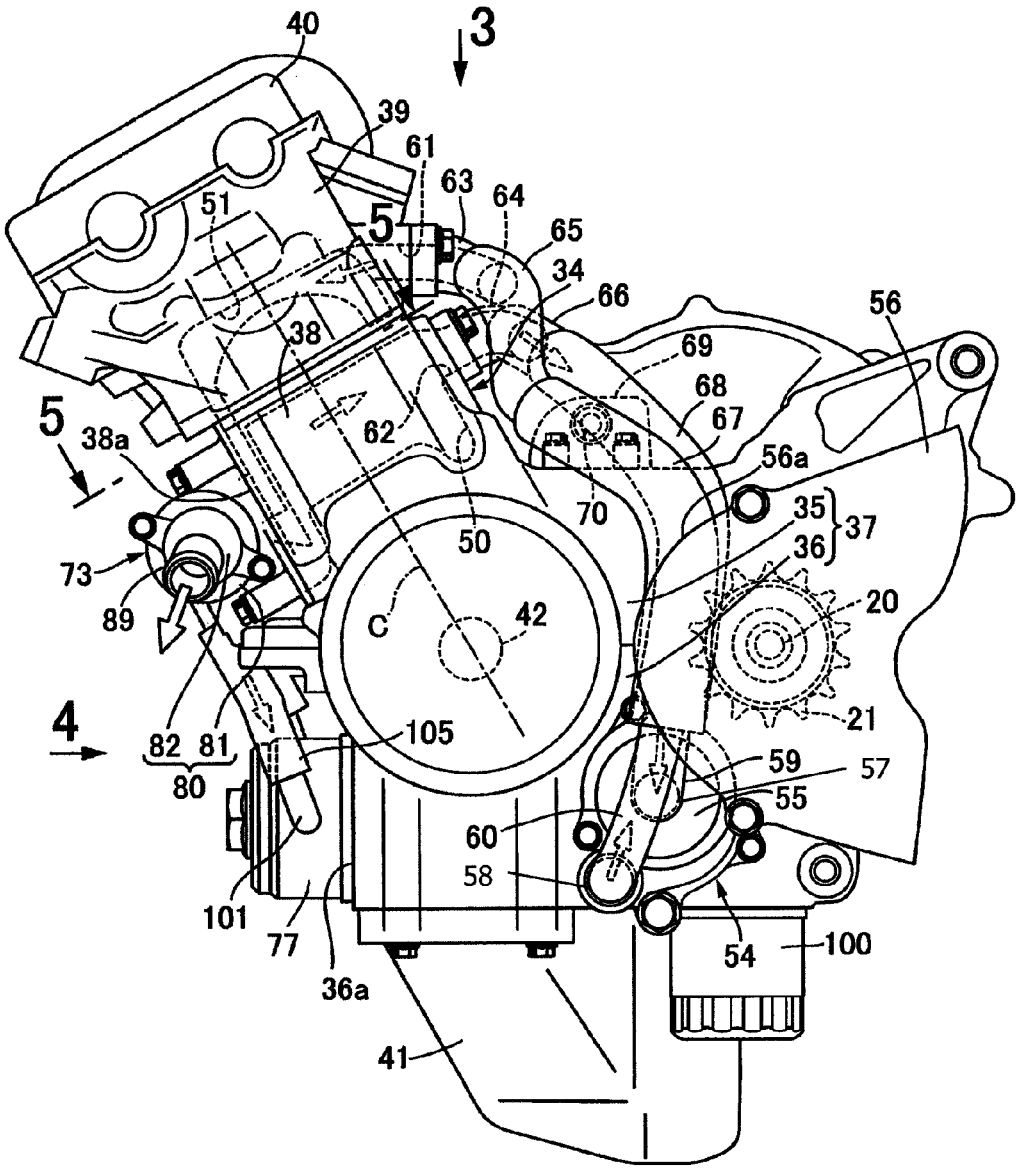
FIG. 2 is a left side view of an engine main body.
Figure 3:
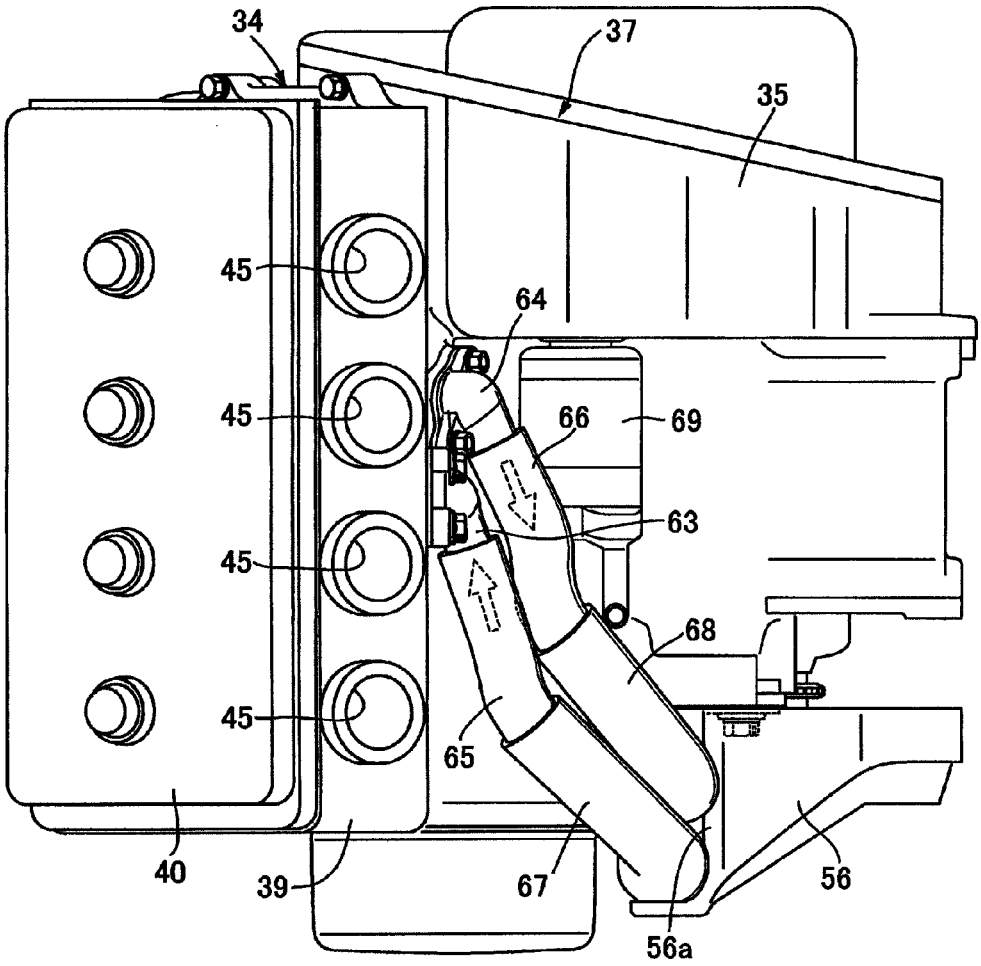
FIG. 3 is a view along arrow 3 in FIG. 2.

Referring to FIGS. 2 and 3 in combination, the engine main body 34 includes a crankcase 37 that is formed by mutual coupling of an upper case half body 35 and a lower case half body 36 and rotatably supports a crankshaft 42 having the axis line along the vehicle width direction. The engine main body 34 further includes a cylinder body 38 formed integrally with the upper case half body 35 in such a manner as to rise from the front part of this crankcase 37 upward with an inclination toward the front side, a cylinder head 39 coupled to the upper end part of this cylinder body 38, and a head cover 40 coupled to this cylinder head 39. An oil pan 41 is coupled to the lower part of the crankcase 37.

Figure 4:
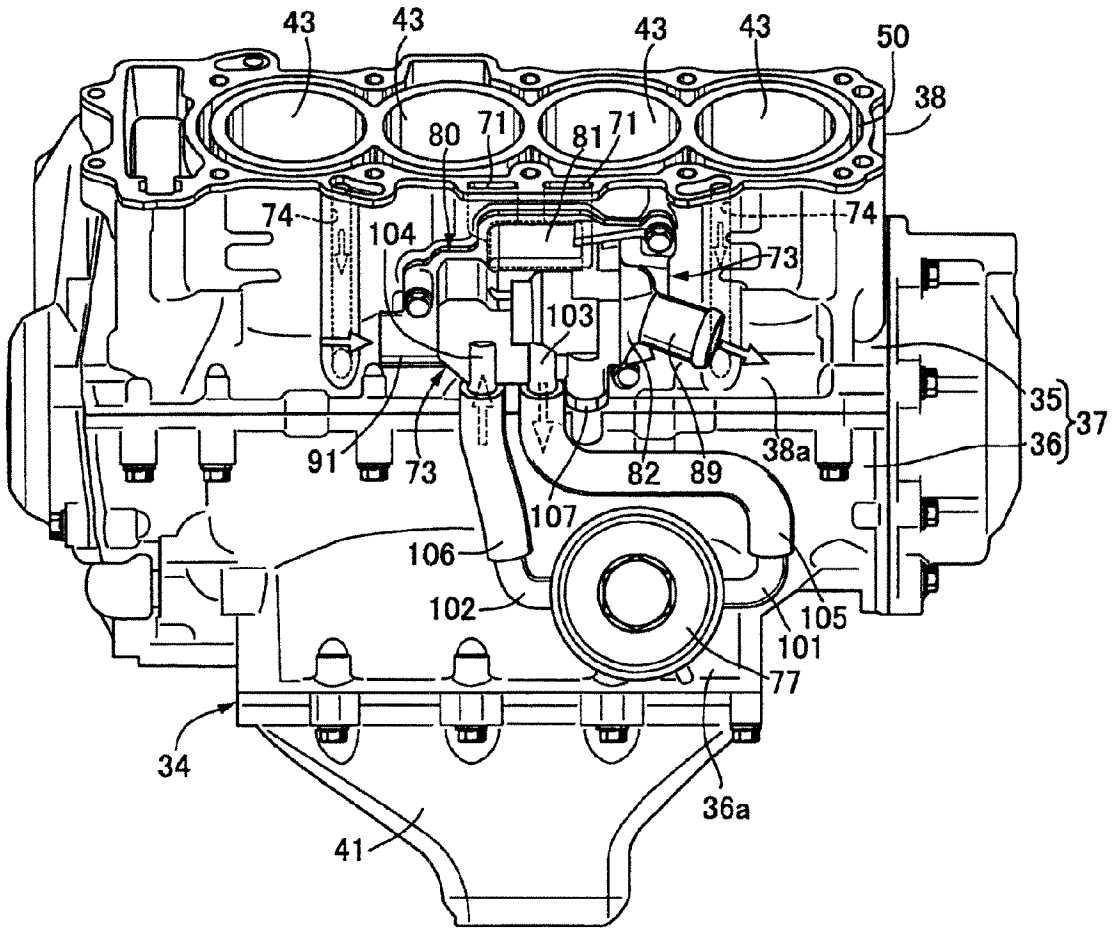
FIG. 4 is a view along arrow 4 in FIG. 2 in the state in which a cylinder head and a head cover are removed.
Figure 5:
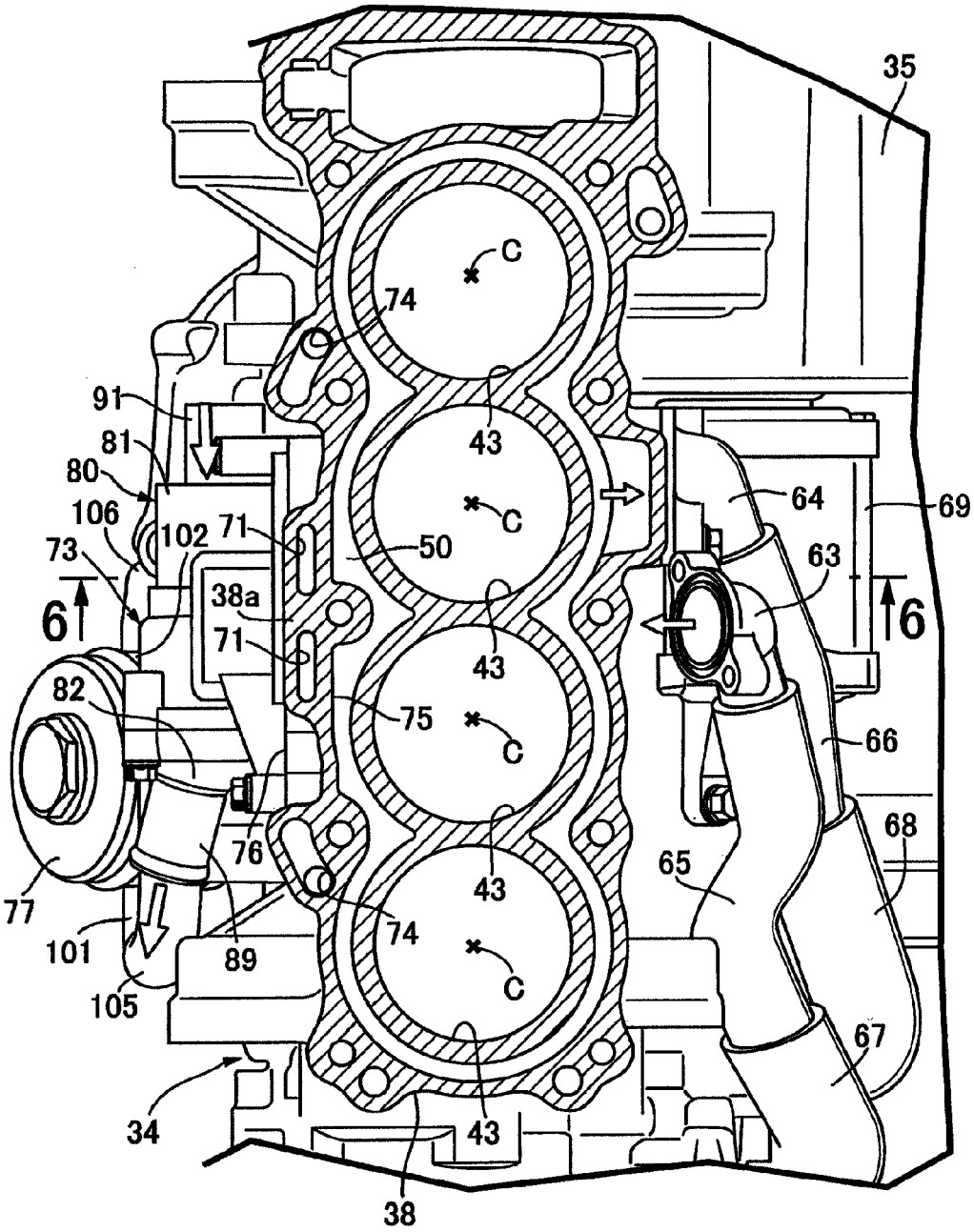
FIG. 5 is a sectional view along line 5-5 in FIG. 2.
Figure 6:
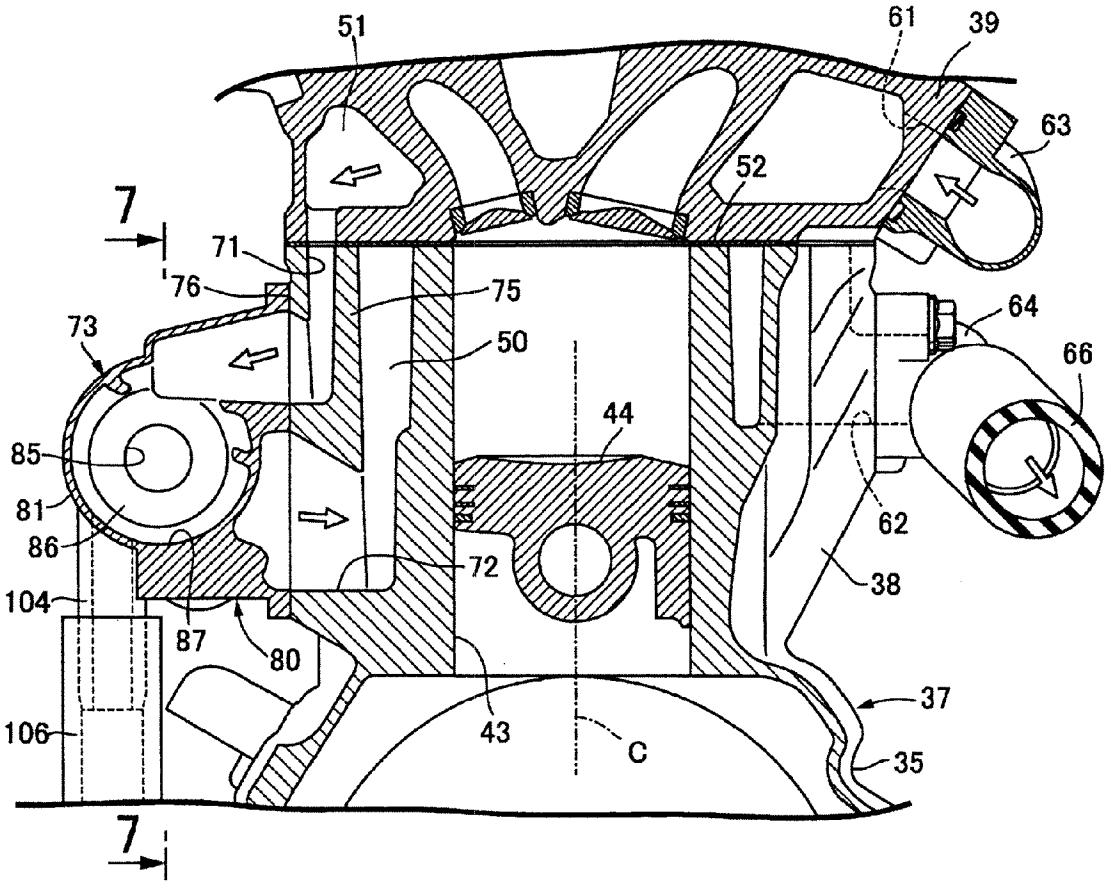
FIG. 6 is a sectional view along line 6-6 in FIG. 5.

Referring to FIGS. 4 to 6 in combination, in the cylinder body 38, plural cylinder bores arranged along the direction of the axis line of the crankshaft 42, i.e. along the vehicle body direction, specifically four cylinder bores 43 in this embodiment, are formed with an inclination of their center axis lines, i.e. cylinder axis lines C (see FIG. 2), toward the front side. Pistons each slidably fitted into a respective one of these cylinder bores 43 are connected to the crankshaft 42 in common.

Intake ports 45 (see FIG. 3) for each of the respective cylinder bores 43 are opened in the rear side surface of the cylinder head 39 and these intake ports 45 are connected to the air cleaner 30 via individual throttle bodies 46 (see FIG. 1). Furthermore, as shown in FIG. 1, the upstream ends of exhaust pipes 47 for each of the respective cylinder bores 43 are connected to the front wall surface of the cylinder head 39 and the downstream ends of these exhaust pipes 47 are connected to an exhaust muffler 48 disposed above the rear wheel WR.

In the cylinder body 38, a cylinder-body-side water jacket 50 is so formed as to surround the cylinder bores 43. A cylinder-head-side water jacket 51 is formed in the cylinder head 39. In addition, as shown in FIG. 6, direct communication of the cylinder-body-side and cylinder-head-side water jackets 50 and 51 with each other is blocked by a gasket 52 set between the cylinder body 38 and the cylinder head 39. Cooling water can be made to flow in the cylinder-body-side and cylinder-head-side water jackets 50 and 51 independently.

As shown in FIG. 1, a radiator 53 is disposed in front of the engine main body 34. In this radiator 53, the cylinder-body-side water jacket 50, and the cylinder-head-side water jacket 51, the cooling water is forcibly circulated by a water pump 54 driven by power transmitted from the crankshaft 42.

The water pump 54 is disposed more rearward than the cylinder body 38 and its pump housing 55 is more rearward than the cylinder body 38 and is fastened to the left sidewall of the lower case half body 36 in the crankcase 37 of the engine main body 34. In addition, part of the pump housing 55 is covered by a sprocket cover 56 that covers the drive sprocket 21 and is fastened to the left sidewall of the crankcase 37.

For the pump housing 55, an inlet pipe 59 that forms an inlet port 57 for drawing in the cooling water and a discharge pipe 60 that forms a discharge port 58 for discharging the cooling water are provided. The inlet port 57 is connected to one of the cylinder-body-side water jacket 50 and the cylinder-head-side water jacket 51, and the discharge port 58 is connected to the other of the cylinder-body-side water jacket 50 and the cylinder-head-side water jacket 51. In this embodiment, the inlet port 57 is connected to the cylinder-body-side water jacket 50 and the discharge port 58 is connected to the cylinder-head-side water jacket 51.

A first connection port 61 communicating with the cylinder-head-side water jacket 51 is provided in the rear wall of the cylinder head 39 and a second connection port 62 communicating with the cylinder-body-side water jacket 50 is provided in the rear wall of the cylinder body 38.

One end part of a first connection pipe 63 communicating with the first connection port 61 is fastened to the rear wall of the cylinder head 39 and the other end part of the first connection pipe 63 is connected to the discharge pipe 60 via a first hose 65. One end part of a second connection pipe 64 communicating with the second connection port 62 is fastened to the rear wall of the cylinder body 38 and the other end part of the second connection pipe 64 is connected to the inlet pipe 59 via a second hose 66.

The intermediate parts of the first and second hoses 65 and 66 are inserted in cylindrical hose support tubes 67 and 68 having rigidity and a holder **56*a* to hold both the hose support tubes 67 and 68 is formed integrally with the sprocket cover 56**.

A starter motor 69 is disposed on the upper wall of the upper case half body 35 in the crankcase 37 behind the cylinder body 38 with its motor shaft 70 (see FIG. 2) set parallel to the crankshaft 42. Rotational power from the motor shaft 70 of this starter motor 69 is transmitted to the crankshaft 42 at the start of the engine E.

Figure 7:
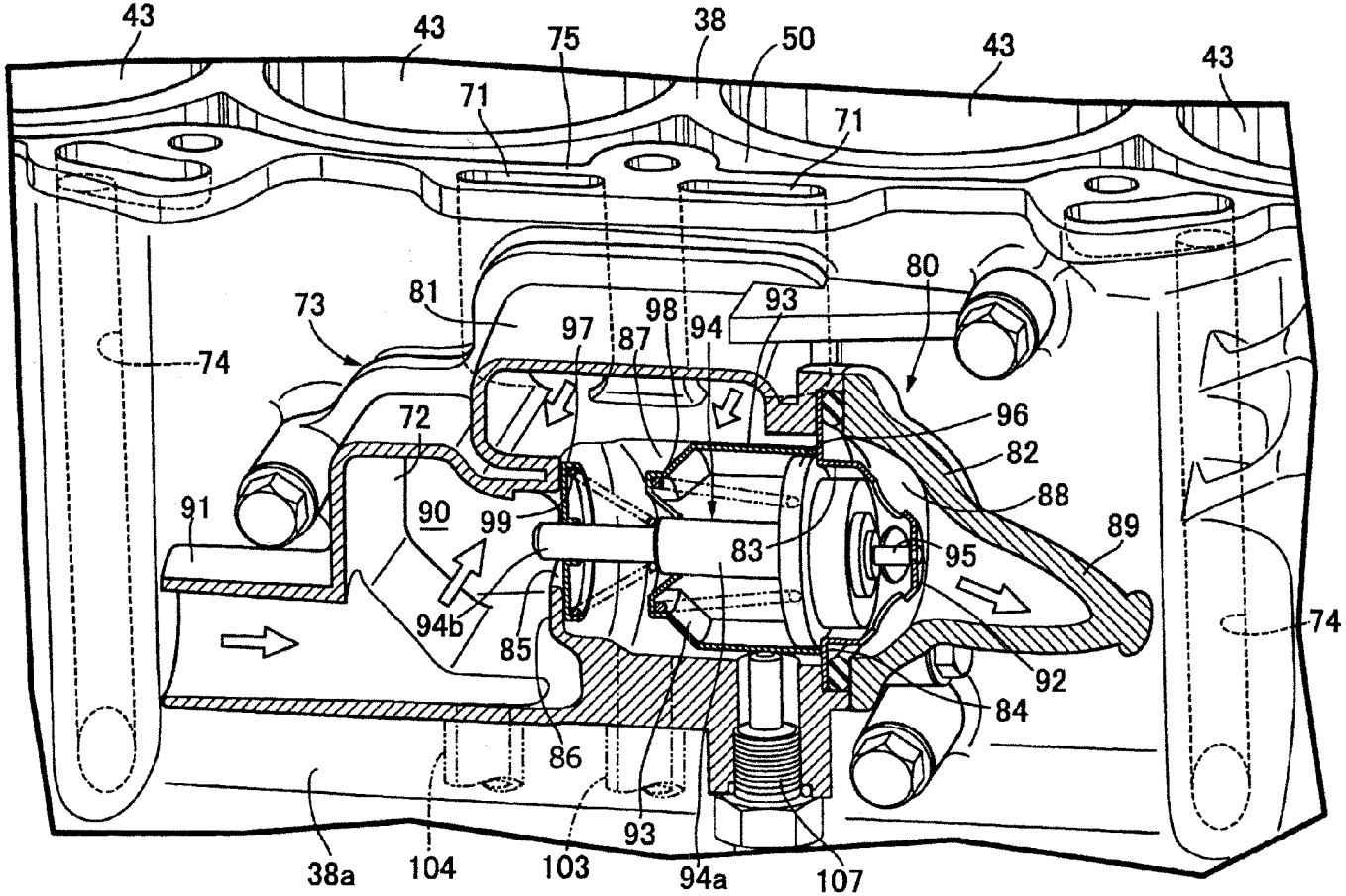
FIG. 7 is a sectional view along line 7-7 in FIG. 6.

Referring to FIG. 7 in a sidewall of the cylinder body 38 facing one side, specifically, in this embodiment, in a front wall **38*a* facing the front side in the state in which the engine main body 34 is mounted on the two-wheeled motor vehicle, a pair of first connection paths 71 communicating with the cylinder-head-side water jacket 51 and a second connection path 72 communicating with the cylinder-body-side water jacket 50 are made. A thermostat valve 73 that can switch between the state in which the first connection paths 71 directly communicate with the second connection path 72 and the state in which the first connection paths 71 are connected to the second connection path 72 via the radiator 53 is attached to an attachment base 76 formed on the front wall 38*a* of the cylinder body 38**.

In the front wall **38*a* of the cylinder body 38, a pair of lubricant return paths 74, to return a lubricant from the cylinder head 39 to the side of the crankcase 37 via the cylinder body 38, are formed at positions separated along the arrangement direction of the cylinder bores 43 in such a manner as to vertically extend. The first connection paths 71 having a flattened cross-sectional shape that is long in the direction along the axis line of the crankshaft 42 are made in the front wall 38***a* of the cylinder body 38 in such a manner that a partition wall 75 exists between the first connection paths 71 and the cylinder-body-side water jacket 50 and the first connection paths 71 are disposed between the pair of lubricant return paths 74.

A water-cooling oil cooler 77 is so attached to one sidewall of the engine main body 34 as to face the same direction as that of the thermostat valve 73 and be disposed below the thermostat valve 73. In this embodiment, because the thermostat valve 73 is attached to the front wall 38*a* of the cylinder body 38, the oil cooler 77 is attached to a front wall 36*a* of the lower case half body 36 in the crankcase 37 below the front wall 38*a* of the cylinder body 38. In addition, the thermostat valve 73 and the oil cooler 77 are disposed between the pair of lubricant return paths 74.

A valve housing 80 of the thermostat valve 73 is composed of a housing main body 81 fastened to the attachment base 76 and a cap 82 liquid-tightly fastened to the housing main body 81.

Between the housing main body 81 and the cap 82, the outer circumferential part of a ring plate 84 having at its center part a first valve hole 83 having the center axis line along the axis line of the crankshaft 42, i.e. along the arrangement direction of the cylinder bores 43, is held. On the inner surface of the housing main body 81, a flange portion 86 extending inward is integrally formed with a second valve hole 85 coaxial with the first valve hole 83 made at the center part of the flange portion 86.

An upstream chamber 87 is formed between the ring plate 84 and the flange portion 86 in the valve housing 80. The upstream chamber 87 communicates with, via the first connection paths 71, the cylinder-head-side water jacket 51 connected to the discharge port 58 of the water pump 54 as one of the cylinder-body-side and cylinder-head-side water jackets 50 and 51. An intermediate chamber 88 is formed between the ring plate 84 and the cap 82 in the valve housing 80. In the cap 82, a lead-out connection pipe 89 for leading the cooling water of the intermediate chamber 88 to the side of the radiator 53 is provided. Furthermore, in the valve housing 80, a downstream chamber 90 is formed on the opposite side to the upstream chamber 87 across the flange portion 86. The downstream chamber 90 communicates with, via the second connection path 72, the cylinder-body-side water jacket 50 connected to the inlet port 57 of the water pump 54 as the other of the cylinder-body-side and cylinder-head-side water jackets 50 and 51. In the housing main body 81, a lead-in connection pipe 91 for taking in the cooling water from the radiator 53 into the downstream chamber 90 is provided.

In the intermediate chamber 88, a shaft support frame 92 that is so formed as to permit the flow of the cooling water and is provided continuously with the inner circumferential part of the ring plate 84 is so housed as to permit the flow of the cooling water. In the upstream chamber 87, a pair of spring bearing arms 93 that are provided continuously with the ring plate 84 and extend toward the opposite side to the shaft support frame 92 are disposed.

At the center part of the shaft support frame 92, one end part of a plunger 95 coaxially protruding from a movable portion 94 extending coaxially with the first and second valve holes 83 and 85 is fixedly supported. The movable portion 94 has a larger-diameter cylindrical portion 94*a* and a smaller-diameter cylindrical portion 94*b* in a coaxial manner and is formed into a stepped cylindrical shape. It can be filled, for example, with wax. Therefore, the other end part of the plunger 95 is inserted into the movable portion 94 from the side of the larger-diameter cylindrical portion 94*a* with the wax existing between the other end part and the movable portion 94.

A first valve body 96 that is seated on the inner circumferential part of the ring plate 84 and can close the first valve hole 83 is provided on the larger-diameter cylindrical portion 94*a* of the movable portion 94. A second valve body 97 that is seated on the inner circumferential part of the flange portion 86 and can close the second valve hole 85 is slidably supported on the smaller-diameter cylindrical portion 94*b* of the movable portion 94. A first spring 98 that biases the first valve body 96 toward the ring plate 84 is provided between the spring bearing arms 93 and the first valve body 96, and a second spring 99 that biases the second valve body 97 toward the flange portion 86 is provided between the movable portion 94 and the second valve body 97.

Such a thermostat valve 73 has the actuation axis line parallel to the axis line of the crankshaft 42. When the cooling water temperature is low, the first and second valve bodies 96 and 97 are actuated to such a side as to close the first valve hole 83 and open the second valve hole 85. In association with the rise of the cooling water temperature, the first and second valve bodies 96 and 97 are actuated to such a side as to open the first valve hole 83 and close the second valve hole 85.

Oil pumped up from the oil pan 41 by an oil pump (not shown) is led to the oil cooler 77 via an oil filter 100 (see FIG. 2) attached to the lower part of the lower case half body 36 in the crankcase 37 below the water pump 54. This oil cooler 77 has a cooling water lead-in pipe 101 for taking in the cooling water to cool the oil and a cooling water lead-out pipe 102 for leading out the cooling water and is attached to the front wall 36*a* of the lower case half body 36 in the crankcase 37. As shown in FIG. 5, when viewed from the direction along the cylinder axis line C, the thermostat valve 73 and the oil cooler 77 are so disposed as to partially overlap with each other.

The cooling water lead-in pipe 101 of the oil cooler 77 is so connected to the thermostat valve 73 as to always communicate with the cylinder-head-side water jacket 51 connected to the discharge port 58 of the water pump 54. The cooling water lead-out pipe 102 is so connected to the thermostat valve 73 as to always communicate with the cylinder-body-side water jacket 50 connected to the inlet port 57 of the water pump 54.

Specifically, an upstream connection pipe 103 continuous with the upstream chamber 87, which always communicates with the cylinder-head-side water jacket 51 and is formed in the valve housing 80 of the thermostat valve 73, and a downstream connection pipe 104 continuous with the downstream chamber 90, which always communicates with the cylinder-body-side water jacket 50 and is formed in the valve housing 80, are provided for the housing main body 81 of the valve housing 80. The cooling water lead-in pipe 101 is connected to the upstream connection pipe 103 via a first external conduit 105 (for example, a hose) and the cooling water lead-out pipe 102 is connected to the downstream connection pipe 104 via a second external conduit 106 (for example, a hose).

In addition, the oil cooler 77 is disposed below the thermostat valve 73 and the upstream connection pipe 103 and the downstream connection pipe 104 are provided under the housing main body 81 in the valve housing 80 in such a manner as to be arranged along the actuation axis line of the thermostat valve 73 and extend along the cylinder axis line C.

Furthermore, under the housing main body 81, a water temperature detection sensor 107 arranged together with the upstream connection pipe 103 and the downstream connection pipe 104 along the actuation axis line of the thermostat valve 73 is so attached as to detect the water temperature in the upstream chamber 87.

Some effects of this embodiment will be described below. The cylinder-body-side and cylinder-head-side water jackets 50 and 51 are so formed that the cooling water is allowed to flow in the water jackets 50 and 51 independently of each other. The pair of first connection paths 71 continuous with the cylinder-head-side water jacket 51 connected to the discharge port 58 of the water pump 54 and the second connection path 72 continuous with the cylinder-body-side water jacket 50 connected to the inlet port 57 of the water pump 54 are made in the front wall 38*a* as a sidewall of the cylinder body 38 facing one side. The thermostat valve 73 that makes switching between the state in which the first and second connection paths 71 and 72 directly communicate with each other and the state in which the first and second connection paths 71 and 72 are connected to each other via the radiator 53 is attached to the front wall 38*a*. The water-cooling oil cooler 77 having the cooling water lead-in pipe 101 for taking in the cooling water and the cooling water lead-out pipe 102 for leading out the cooling water is so attached to one sidewall of the engine main body 34 as to face the same direction as that of the thermostat valve 73. The cooling water lead-in pipe 101 is so connected to the thermostat valve 73 as to always communicate with the cylinder-head-side water jacket 51, and the cooling water lead-out pipe 102 is so connected to the thermostat valve 73 as to always communicate with the cylinder-body-side water jacket 50. Due to this structure, the length of the pipework connected to the oil cooler 77 can be set short.

The valve housing 80 of the thermostat valve 73 has the upstream chamber 87 communicating with the cylinder-head-side water jacket 51 and the downstream chamber 90 always communicating with the cylinder-body-side water jacket 50 and is attached to the front wall 38*a* of the cylinder body 38. The cooling water lead-in pipe 101 of the oil cooler 77 is connected via the first external conduit 105 to the upstream connection pipe 103 provided for the valve housing 80 continuously with the upstream chamber 87, and the cooling water lead-out pipe 102 of the oil cooler 77 is connected via the second external conduit 106 to the downstream connection pipe 104 provided for the valve housing 80 continuously with the downstream chamber 90. Thus, the following advantages are achieved compared with a structure in which the cooling water lead-in pipe 101 and the cooling water lead-out pipe 102 of the oil cooler 77 are connected to a branch joint provided in the middle of the external pipework coupling the oil cooler 77 to the radiator 53. Specifically, the first and second external conduits 105 and 106 can be set short. Furthermore, the branch joint in the middle of the pipework can be eliminated to simplify the pipework connection structure and the seal part can be reduced with ensuring of the arrangement flexibility of the cooling water lead-in pipe 101 and the cooling water lead-out pipe 102.

The attachment base 76 for attaching the valve housing 80 is formed on the outer surface of the front wall 38*a* of the cylinder body 38 and the oil cooler 77 is attached to the front wall 36*a* of the crankcase 37 below the thermostat valve 73. This can eliminate external pipework between the thermostat valve 73 and the cylinder body 38 and shorten the distance between the thermostat valve 73 and the oil cooler 77 to further shorten the first and second external conduits 105 and 106.

The radiator 53 is disposed in front of the engine main body 34 and the water pump 54 is disposed more rearward than the cylinder body 38. The first connection port 61 that is connected to the discharge port 58 of the water pump 54 and is continuous with the cylinder-head-side water jacket 51 is provided in the rear wall of the cylinder head 39, and the second connection port 62 that is connected to the inlet port 57 of the water pump 54 and is continuous with the cylinder-body-side water jacket 50 is provided in the rear wall of the cylinder body 38. Thus, exchange of the cooling water between the cylinder-body-side water jacket 50 and the cylinder-head-side water jacket 51 and the water pump 54 is carried out on the rear side of the engine main body 34. This can shorten the circulation route of the cooling water.

The thermostat valve 73 is attached to the cylinder body 38 with its actuation axis line set parallel to the axis line of the crankshaft 42, and the upstream connection pipe 103 and the downstream connection pipe 104 are so provided under the valve housing 80 as to be arranged along the actuation axis line. Thus, the directions of the first and second external conduits 105 and 106 between the thermostat valve 73 and the oil cooler 77 disposed below the thermostat valve 73 can be aligned to shorten external conduits 105 and 106.

The upstream connection pipe 103 and the downstream connection pipe 104 are so formed as to extend along the cylinder axis line C. Therefore, the first and second external conduits 105 and 106 between the thermostat valve 73 and the oil cooler 77 can be disposed close to the front wall of the engine main body 34 naturally. This can suppress size increase of the engine E including these external conduits 105 and 106.

The thermostat valve 73 and the oil cooler 77 are so disposed as to partially overlap with each other when viewed from the direction along the cylinder axis line C. This can further shorten the distance between the thermostat valve 73 and the oil cooler 77.

The plural cylinder bores 43 arranged along the axis line of the crankshaft 42 are formed in the cylinder body 38. The pair of lubricant return paths 74 to return the lubricant from the cylinder head 39 to the side of the crankcase 37 via the cylinder body 38 are formed in the front wall 38*a* of the cylinder body 38 with an interval along the arrangement direction of the cylinder bores 43. The thermostat valve 73 and the oil cooler 77 are disposed between the pair of lubricant return paths 74. Thus, the thermostat valve 73 and the oil cooler 77 are effectively disposed in the space between both the lubricant return paths 74. This can suppress size increase of the engine E and shorten the distance between the thermostat valve 73 and the oil cooler 77.

The pair of first connection paths 71 that are continuous with the cylinder-head-side water jacket 51 and have a flattened cross-sectional shape that is long in the direction along the axis line of the crankshaft 42 are made in the front wall 38*a* of the cylinder body 38 in such a manner that the partition wall 75 exists between the first connection paths 71 and the cylinder-body-side water jacket 50 and the first connection paths 71 are disposed between the pair of lubricant return paths 74. Therefore, the first connection paths 71 can be so disposed that interference with the lubricant return paths 74 is avoided and frontward bulging of the front wall 38*a* of the cylinder body 38 is suppressed to avoid size increase of the engine main body 34.

Although embodiments of the present invention is explained above, the present invention is not limited to the above-described embodiments and various design changes can be made without departing from the present invention set forth in the scope of claims.

DESCRIPTION OF REFERENCE SYMBOLS

34 . . . Engine main body
36*a* . . . Front wall of crankcase
37 . . . Crankcase
38 . . . Cylinder body
38*a* . . . Front wall of cylinder body 38
39 . . . Cylinder head
42 . . . Crankshaft
43 . . . Cylinder bore
50 . . . Cylinder-body-side water jacket
51 . . . Cylinder-head-side water jacket
53 . . . Radiator
54 . . . Water pump
57 . . . Inlet port
58 . . . Discharge port
71 . . . First connection path
72 . . . Second connection path
73 . . . Thermostat valve
76 . . . Attachment base
77 . . . Oil cooler
80 . . . Valve housing
87 . . . Upstream chamber
90 . . . Downstream chamber
101 . . . Cooling water lead-in pipe
102 . . . Cooling water lead-out pipe
103 . . . Upstream connection pipe
104 . . . Downstream connection pipe
105 . . . First external conduit
106 . . . Second external conduit
61 . . . First connection port
62 . . . Second connection port
74 . . . Lubricant return path
75 . . . Partition
C . . . Cylinder axis line
E . . . Engine

The invention claimed is:

1. A water-cooled engine, comprising:

a cylinder-body-side water jacket disposed in a cylinder body that is coupled to a crankcase rotatably supporting a crankshaft and has a cylinder bore;

a cylinder-head-side water jacket disposed in a cylinder head coupled to the cylinder body;

a water pump configured to circulate cooling water between the cylinder-body-side and cylinder-head-side water jackets and a radiator, said water pump being disposed on an engine main body, wherein the cylinder-body-side and cylinder-head-side water jackets are configured such that the cooling water is allowed to flow in the water jackets independently of each other, a first connection path continuous with the cylinder-head-side water jacket connected to one of an inlet port and a discharge port of the water pump and a second connection path continuous with the cylinder-body-side water jacket connected to another of the inlet port and the discharge port are disposed in a sidewall of the cylinder body, said engine further comprising a thermostat valve configured to switch between a state in which the first and second connection paths communicate with each other and a state in which the first and second connection paths are connected to each other via the radiator, said thermostat valve being attached to the sidewall of the cylinder body; and a water-cooling oil cooler having a cooling water lead-in pipe configured to take in the cooling water and a cooling water lead-out pipe configured to lead out the cooling water is so attached to one sidewall of the engine main body as to protrude in a same direction as an actuation axis line of the thermostat valve, wherein the cooling water lead-in pipe is so connected to the thermostat valve as to communicate with the water jacket connected to the discharge port of the water pump, of the cylinder-body-side and cylinder-head-side water jackets, and the cooling water lead-out pipe is so connected to the thermostat valve as to communicate with the water jacket connected to the inlet port of the water pump, of the cylinder-body-side and cylinder-head-side water jackets.

2. The water-cooled engine according to claim 1, wherein the thermostat valve comprises a valve housing having an upstream chamber communicating with the water jacket connected to the discharge port of the water pump, of the cylinder-body-side and cylinder-head-side water jackets, and a downstream chamber communicating with the water jacket connected to the inlet port of the water pump, of the cylinder-body-side and cylinder-head-side water jackets, and is attached to the sidewall of the cylinder body, and wherein the cooling water lead-in pipe is connected via a first external conduit to an upstream connection pipe provided for the valve housing continuously with the upstream chamber, and the cooling water lead-out pipe is connected via a second external conduit to a downstream connection pipe provided for the valve housing continuously with the downstream chamber.

3. The water-cooled engine according to claim 2, wherein the sidewall of the cylinder body includes a front wall facing a front side in a state in which the engine main body is mounted on a vehicle, and wherein an attachment base configured to attach the valve housing is disposed on an outer surface of the front wall, and the oil cooler is attached to a front wall of the crankcase below the thermostat valve.

4. The water-cooled engine according to claim 3, wherein the radiator is disposed in front of the engine main body and the water pump is disposed more rearward than the cylinder body, and wherein a first connection port is connected to the one of the inlet port and the discharge port of the water pump, and is continuous with the cylinder-head-side water jacket, said first connection port being disposed in a rear wall of the cylinder head, and wherein a second connection port is connected to the another of the inlet port and the discharge port and is continuous with the cylinder-body-side water jacket, said second connection port being disposed in a rear wall of the cylinder body.

5. The water-cooled engine according to claim 3, wherein the thermostat valve is attached to the cylinder body with the actuation axis line of the thermostat valve set parallel to an axis line of the crankshaft, and wherein the upstream connection pipe and the downstream connection pipe are so provided under the valve housing as to be disposed along the actuation axis line.

6. The water-cooled engine according to claim 5, wherein the upstream connection pipe and the downstream connection pipe are configured to extend along a cylinder axis line (C).

7. The water-cooled engine according to claim 5, wherein the thermostat valve and the oil cooler are disposed to partially overlap with each other when viewed from direction along the cylinder axis line.

8. The water-cooled engine according to claim 5, further comprising:

plural cylinder bores disposed in the cylinder body along the axis line of the crankshaft; and a pair of lubricant return paths configured to return a lubricant from the cylinder head to a side of the crankcase via the cylinder body, said pair of lubricant return paths being disposed in the front wall of the cylinder body with an interval along an arrangement direction of the plural cylinder bores, wherein the thermostat valve and the oil cooler are disposed between the pair of lubricant return paths.

9. The water-cooled engine according to claim 8, wherein the first connection path is continuous with the cylinder-head-side water jacket and has a flattened cross-sectional shape which is long in direction along the axis line of the crankshaft is disposed in the front wall of the cylinder body in such a manner that a partition wall exists between the first connection path and the cylinder-body-side water jacket, and wherein the first connection path is disposed between the pair of lubricant return paths.

10. A water-cooled engine, comprising:

cylinder-body-side water jacket means for containing cooling water disposed in a cylinder body that is coupled to a crankcase rotatably supporting a crankshaft and has a cylinder bore;

cylinder-head-side water jacket means for containing the cooling water disposed in a cylinder head coupled to the cylinder body;

water pump means for circulating the cooling water between the cylinder-body-side and cylinder-head-side water jacket means and a radiator means, said water pump means being disposed on an engine main body, wherein the cylinder-body-side and cylinder-head-side water jacket means are also for allowing the cooling water to flow in the water jacket means independently of each other;

first connection path means continuous with the cylinder-head-side water jacket means connected to one of an inlet port and a discharge port of the water pump means and a second connection path means continuous with the cylinder-body-side water jacket means connected to another of the inlet port and the discharge port are disposed in a sidewall of the cylinder body, said engine further comprising thermostat valve means for switching between a state in which the first and second connection path means communicate with each other and a state in which the first and second connection path means are connected to each other via the radiator, said thermostat valve means being attached to the sidewall of the cylinder body; and water-cooling oil cooler means having cooling water lead-in means for taking in the cooling water and cooling water lead-out means for leading out the cooling water is so attached to one sidewall of the engine main body as to protrude in a same direction as an actuation axis line of the thermostat valve means, wherein the cooling water lead-in means is so connected to the thermostat valve means as to communicate with the water jacket means connected to the discharge port of the water pump means, of the cylinder-body-side and cylinder-head-side water jacket means, and the cooling water lead-out means is so connected to the thermostat valve means as to communicate with the water jacket means connected to the inlet port of the water pump means, of the cylinder-body-side and cylinder-head-side water jacket means.

11. The water-cooled engine according to claim 10, wherein the thermostat valve means comprises a valve housing having an upstream chamber communicating with the water jacket connected to the discharge port of the water pump, of the cylinder-body-side and cylinder-head-side water jacket means, and a downstream chamber communicating with the water jacket means connected to the inlet port of the water pump means, of the cylinder-body-side and cylinder-head-side water jacket means, and is attached to the sidewall of the cylinder body, and wherein the cooling water lead-in means is connected via a first external conduit to an upstream connection pipe provided for the valve housing continuously with the upstream chamber, and the cooling water lead-out means is connected via a second external conduit to a downstream connection pipe provided for the valve housing continuously with the downstream chamber.

12. The water-cooled engine according to claim 11, wherein the sidewall of the cylinder body includes a front wall facing a front side in a state in which the engine main body is mounted on a vehicle, and wherein an attachment base configured to attach the valve housing is disposed on an outer surface of the front wall, and the oil cooler means is attached to a front wall of the crankcase below the thermostat valve means.

13. The water-cooled engine according to claim 12, wherein the radiator is disposed in front of the engine main body and the water pump means is disposed more rearward than the cylinder body, and wherein a first connection port is connected to the one of the inlet port and the discharge port of the water pump means, and is continuous with the cylinder-head-side water jacket, said first connection port being disposed in a rear wall of the cylinder head, and wherein a second connection port is connected to the another of the inlet port and the discharge port and is continuous with the cylinder-body-side water jacket means, said second connection port being disposed in a rear wall of the cylinder body.

14. The water-cooled engine according to claim 12, wherein the thermostat valve means is attached to the cylinder body with the actuation axis line of the thermostat valve set parallel to an axis line of the crankshaft, and wherein the upstream connection pipe and the downstream connection pipe are so provided under the valve housing as to be disposed along the actuation axis line.

15. The water-cooled engine according to claim 14, wherein the upstream connection pipe and the downstream connection pipe are configured to extend along a cylinder axis line (C).

16. The water-cooled engine according to claim 14, wherein the thermostat valve means and the oil cooler means are disposed to partially overlap with each other when viewed from direction along the cylinder axis line.

17. The water-cooled engine according to claim 14, further comprising:

plural cylinder bores disposed in the cylinder body along the axis line of the crankshaft; and lubricant return means for returning a lubricant from the cylinder head to a side of the crankcase via the cylinder body, said lubricant return means being disposed in the front wall of the cylinder body with an interval along an arrangement direction of the plural cylinder bores, wherein the thermostat valve means and the oil cooler means are disposed between two paths of the lubricant return means.

18. The water-cooled engine according to claim 17, wherein the first connection path means is continuous with the cylinder-head-side water jacket means and has a flattened cross-sectional shape which is long in direction along the axis line of the crankshaft is disposed in the front wall of the cylinder body in such a manner that a partition wall exists between the first connection path means and the cylinder-body-side water jacket means, and wherein the first connection path means is disposed between the two paths of the lubricant return means.

* * * * *